US008079532B2

(12) United States Patent
Baird

(10) Patent No.: US 8,079,532 B2
(45) **Date of Patent: *Dec. 20, 2011**

(54) ENERGY EFFICIENT WATER SPRINKLER

(76) Inventor: Jeffery D. Baird, Ada, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/380,043

(22) Filed: Feb. 23, 2009

(65) Prior Publication Data

US 2009/0159721 A1 Jun. 25, 2009

Related U.S. Application Data

(63) Continuation of application No. 11/789,775, filed on Apr. 25, 2007, now Pat. No. 7,494,071.

(60) Provisional application No. 60/794,748, filed on Apr. 25, 2006.

(51) Int. Cl.
*B05B 3/04* (2006.01)

(52) U.S. Cl. ..... 239/240; 239/243; 239/380; 239/381; 239/382; 239/225.1; 239/222.13; 239/222.11; 239/222.15; 239/222

(58) Field of Classification Search ..... 239/225.1, 239/243, 240, 244, 251, 263, 222, 233, 231, 239/237, 249, 380, 381, 382, 383, 222.13, 222.11, 222.15, 222.17, 222.19, 222.21, 214.13
See application file for complete search history.

(56) References Cited

U.S. PATENT DOCUMENTS

| | | | | | |
|---|---|---|---|---|---|
| 1,847,763 | A * | 3/1932 | Keys | 239/230 |
| 1,965,912 | A * | 7/1934 | Strawn | 239/227 |
| 4,957,240 | A * | 9/1990 | Rosenberg | 239/233 |
| 5,746,375 | A * | 5/1998 | Guo | 239/245 |
| 7,475,832 | B2 * | 1/2009 | Amron | 239/23 |
| 2005/0127203 | A1 * | 6/2005 | DeWitt | 239/200 |
| 2006/0273188 | A1 * | 12/2006 | Amron | 239/23 |
| 2006/0273199 | A1 * | 12/2006 | Amron | 239/333 |
| 2007/0041859 | A1 * | 2/2007 | Nagler | 418/112 |

* cited by examiner

*Primary Examiner* — Len Tran
*Assistant Examiner* — Trevor E McGraw

(57) ABSTRACT

An energy efficient water sprinkler has a housing with primary and secondary water chambers each with a turning wheel for translating the force of impacting water to rotational motion of a central shaft journal. Water is forced through a central channel in the rotating shaft and discharged from the housing. A portion of the discharged water is directed to deflection fins on the outer surface of the housing to further impart rotational or energy to the rotating shaft.

7 Claims, 12 Drawing Sheets

ENERGY EFFICIENT WATER SPRINKLER

This is a continuation application claiming priority to and incorporating by reference herein U.S. provisional patent application Ser. No. 60/794,748, filed Apr. 25, 2006; and co-pending U.S. patent application Ser. No. 11/789,775, filed Apr. 25, 2007 now U.S. Pat. No. 7,494,071.

BACKGROUND OF THE INVENTION

The present invention relates to an improved water sprinkler system. Typical household water pressure is 50-60 psi. A hose having a ⅝"-¾" inside diameter will usually deliver 4 to 6 gallons of water per minute at those pressures. Sprinklers which use pressure to deliver water in various discharge patterns essentially restrict flow and reduce the gallons per minute (flow rate) delivered. Further, most current devices have numerous small parts which are susceptible to lime, calcium, and dirt residue buildups which additionally restrict water flow. There is a need for a sprinkler which provides a full volume flow with little restriction.

SUMMARY OF THE INVENTION

The present invention utilizes the total line pressure and total water volume to operate a rotating spray header to provide a distribution pattern of water. The power in and power out ratio of the rotating axle of the present device provides a device which is capable of mechanical crawling or even hovering.

The present invention utilizes centrifugal force developed by rotors to assist in the rotation of a main shaft having the water distribution nozzles as will be fully understood in the attached drawing. Additional weights may be added to the ends of the primary wheel or turbine to add a kinetic energy which results in a pull from the supply line and "supercharge" of the secondary chamber. The rotational torque assist obtained from the inlet water contacting the primary wheel depends on the length of the wheel blades from the center of the axle and the line pressure and water volume. The rotational torque assist attained from the secondary wheel depends upon the effective length of the arcuate blade from the center of the axle and the pressure and water volume into the secondary chamber from the primary chamber.

DESCRIPTION OF THE PREFERRED EMBODIMENT

Figure 1:
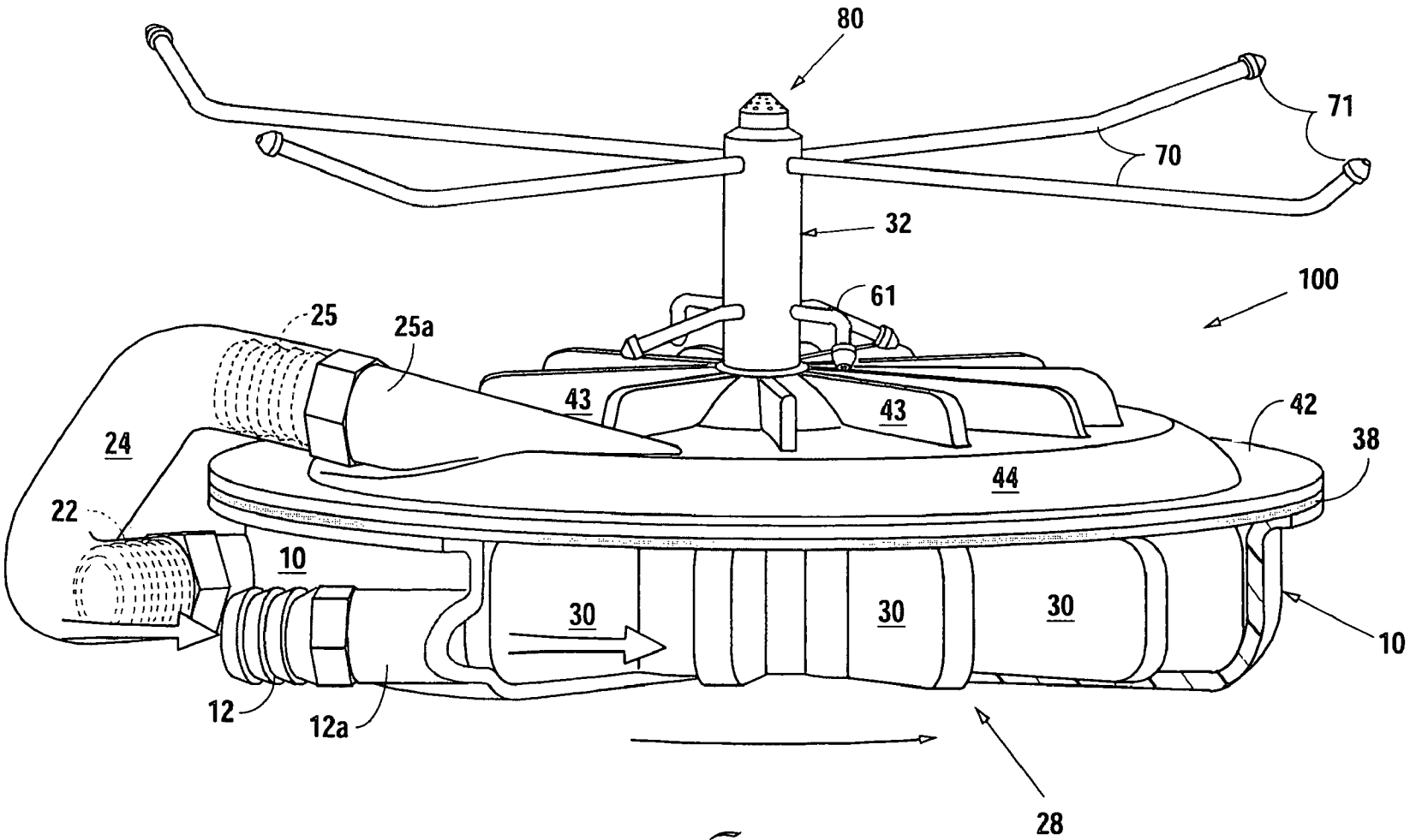
FIG. 1 is a partial cutaway, side-elevation, perspective view of the present invention.
Figure 10:
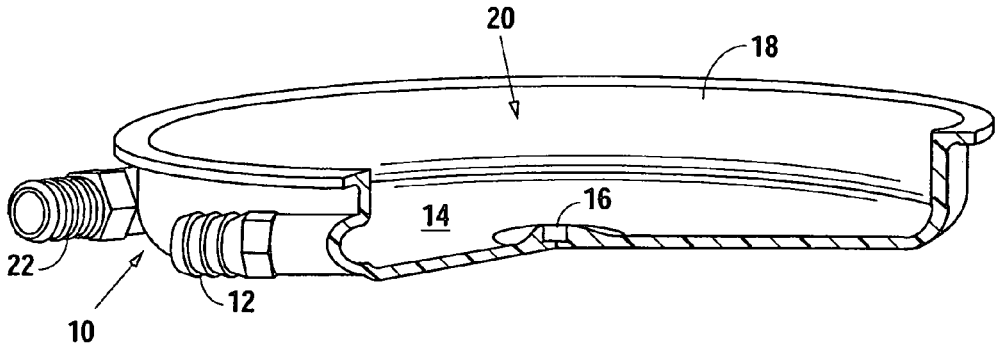
FIG. 10 illustrates a partial cutaway view of the base cover with the inlet conduit to the base chamber and the discharge conduit for fluid communication with the secondary chamber.

FIG. 1 shows a partial cutaway, side perspective view of the water sprinkler 100 of the present invention. Supply water from a source (not shown) enters the base cover section 10 through inlet conduit 12 at a predetermined pressure and volume. The base cover section 10 has a bottom 14 (see FIG. 10) with a main shaft support journal shoulder 16 and side walls 18 to create a volume or a primary chamber 20, which has an opening 12*a* in fluid communication with the inlet conduit 12, as will be described below. Base cover 10 has a fluid discharge conduit 22, which is in fluid communication with a discharge opening 22*a* in the chamber 20, which directs pressurized water exiting the primary chamber 20 into a transfer conduit or hose 24, then through secondary chamber inlet conduit 25 through secondary chamber inlet opening 25*a*, and into a secondary chamber 26 (FIGS. 3 and 5).

Figure 11:
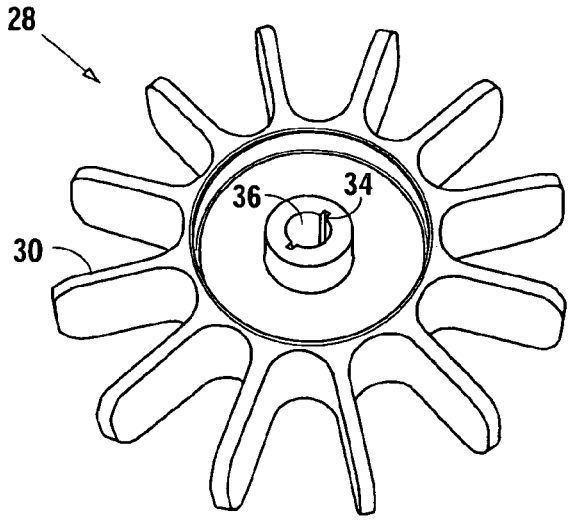
FIG. 11 is a top perspective view of the primary wheel which attaches through the opening in the hub to the main shaft.

As pressurized water enters primary chamber 20 (FIG. 1), it impacts primary rotor or wheel 28 which has a plurality of radially extending blades 30. The wheel 28 is attached to the main shaft 32 at a central hub 34 having a keyed opening 36 for receiving the shaft 32 as shown in FIG. 11. Key portion 58 of shaft 32 (FIG. 12) cooperates with the keyed opening 36 of wheel 28. Wheel 28 thus rotates within the chamber 20 as a result of impacting water which translates and imparts rotational force to the shaft.

Figure 2:
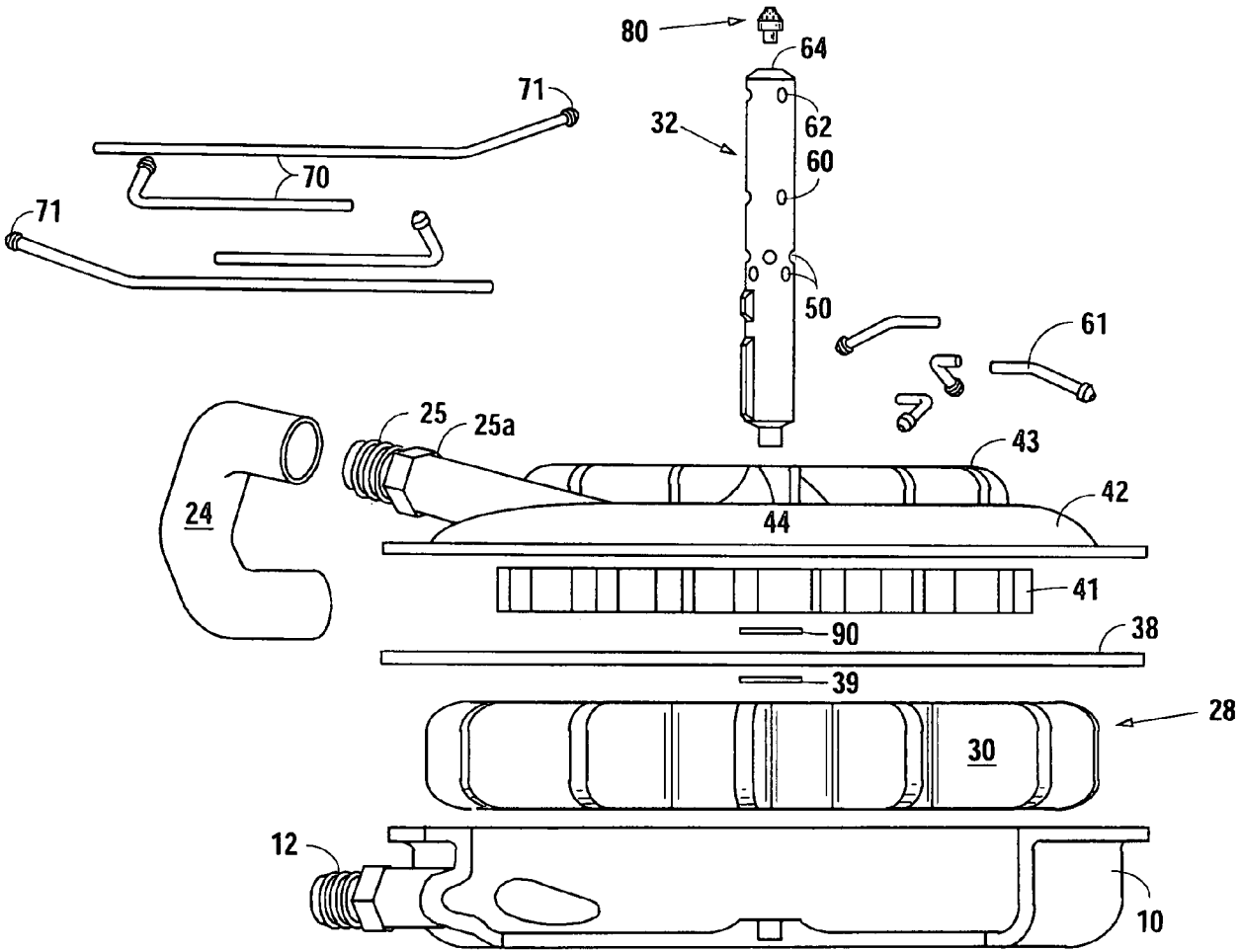
FIG. 2 is a side-elevation exploded view of the present invention showing the various separate parts.
Figure 3:
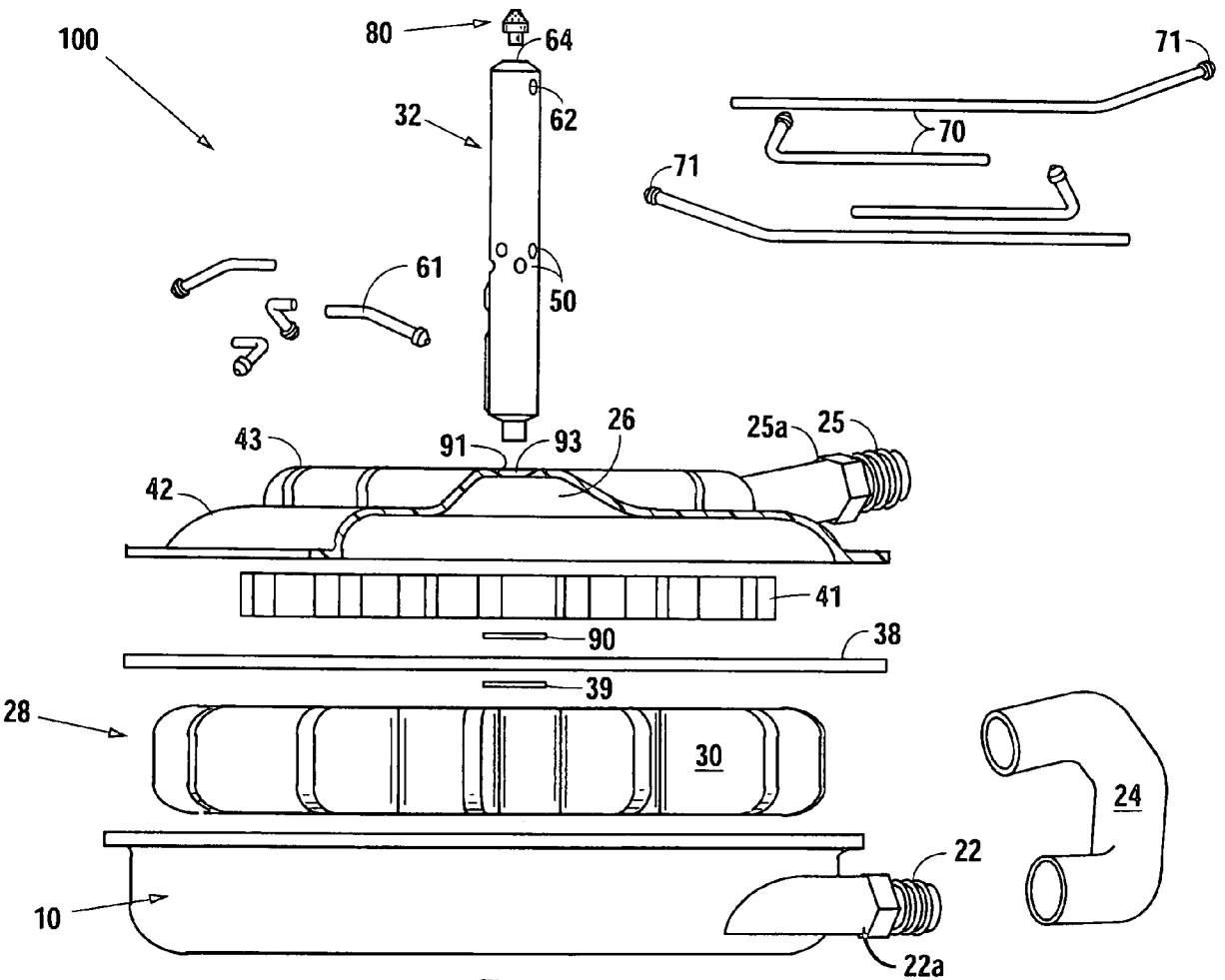
FIG. 3 is an opposite side-elevation exploded view of the present invention showing the various separate parts.
Figure 13:
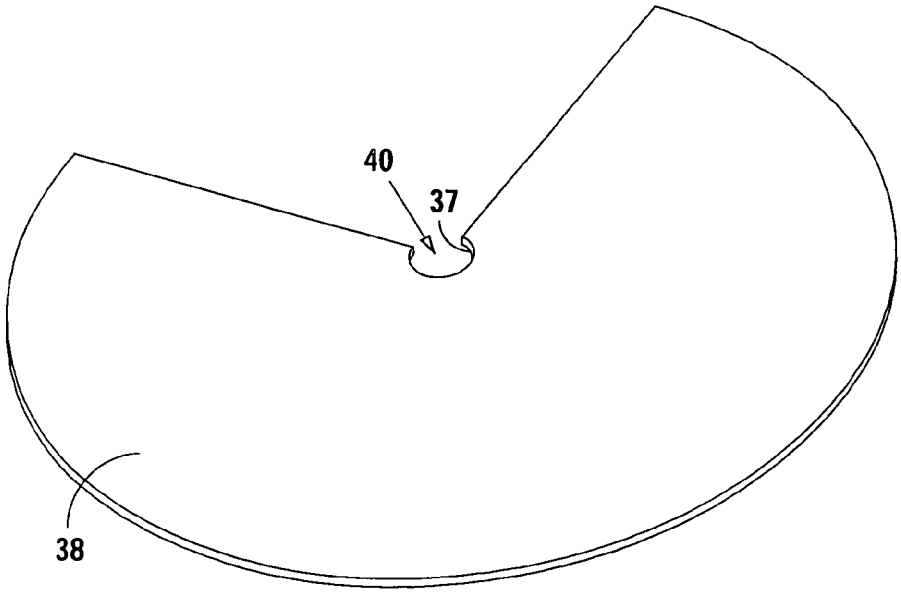
FIG. 13 is a simple, partial cutaway perspective view of the base cap plate which separates the primary chamber from the secondary chamber and provides a sealable opening for receiving the rotatable main shaft.

FIGS. 2 and 3 illustrate the separate parts of the present invention 100. As will be understood by further review of the drawings and this description, chamber 20 is formed by the volume formed within the base cover 10 and top cap plate 38. An O-ring 39 is retained in a groove 37 in the shaft opening 40 of the cap plate 38, and is elastically urged against the shaft to seal the water pressure in chamber 20 as shown in FIGS. 5 and 13.

Figure 4:
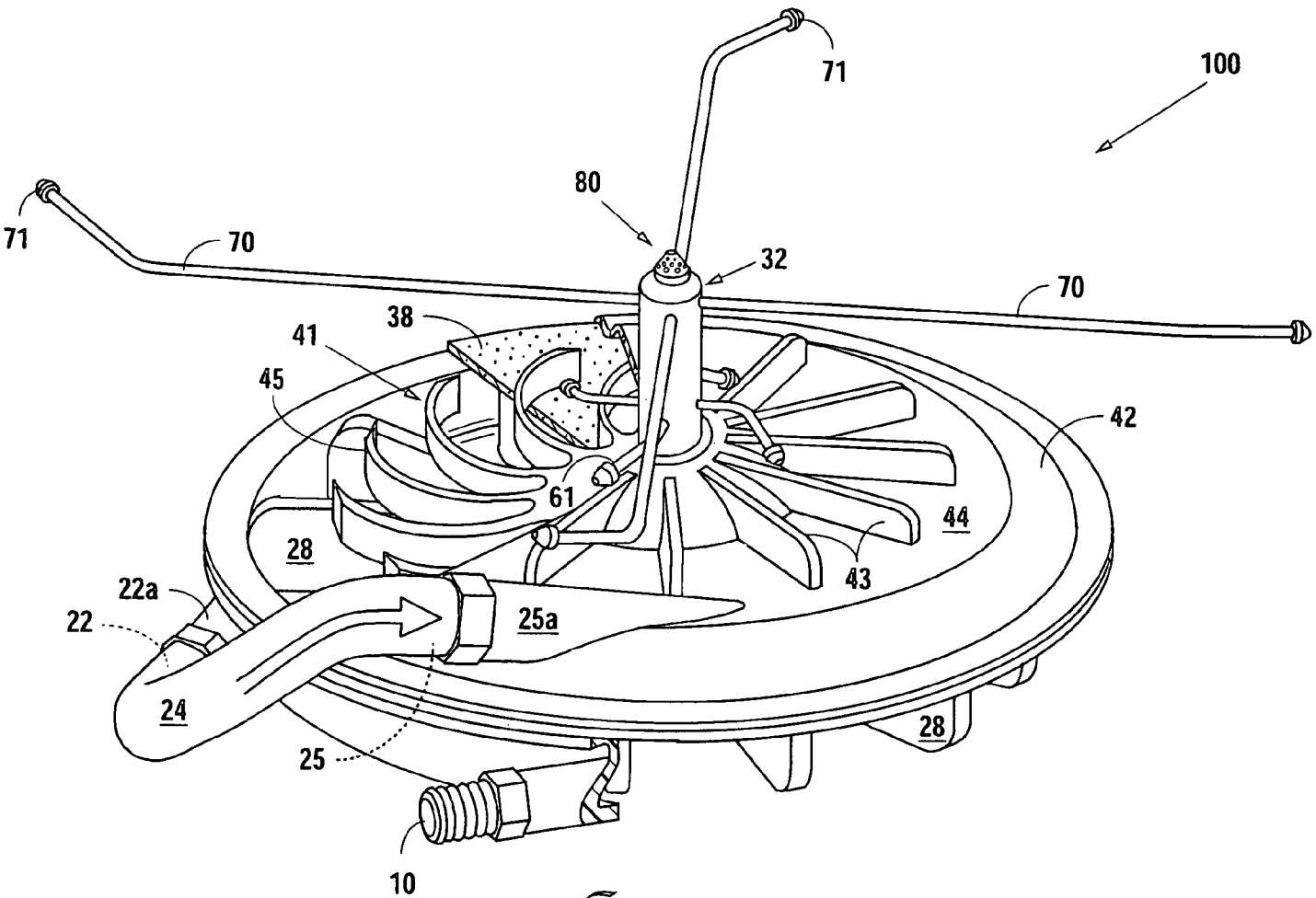
FIG. 4 illustrates a partial cutaway top side perspective view of the present invention.
Figure 5:
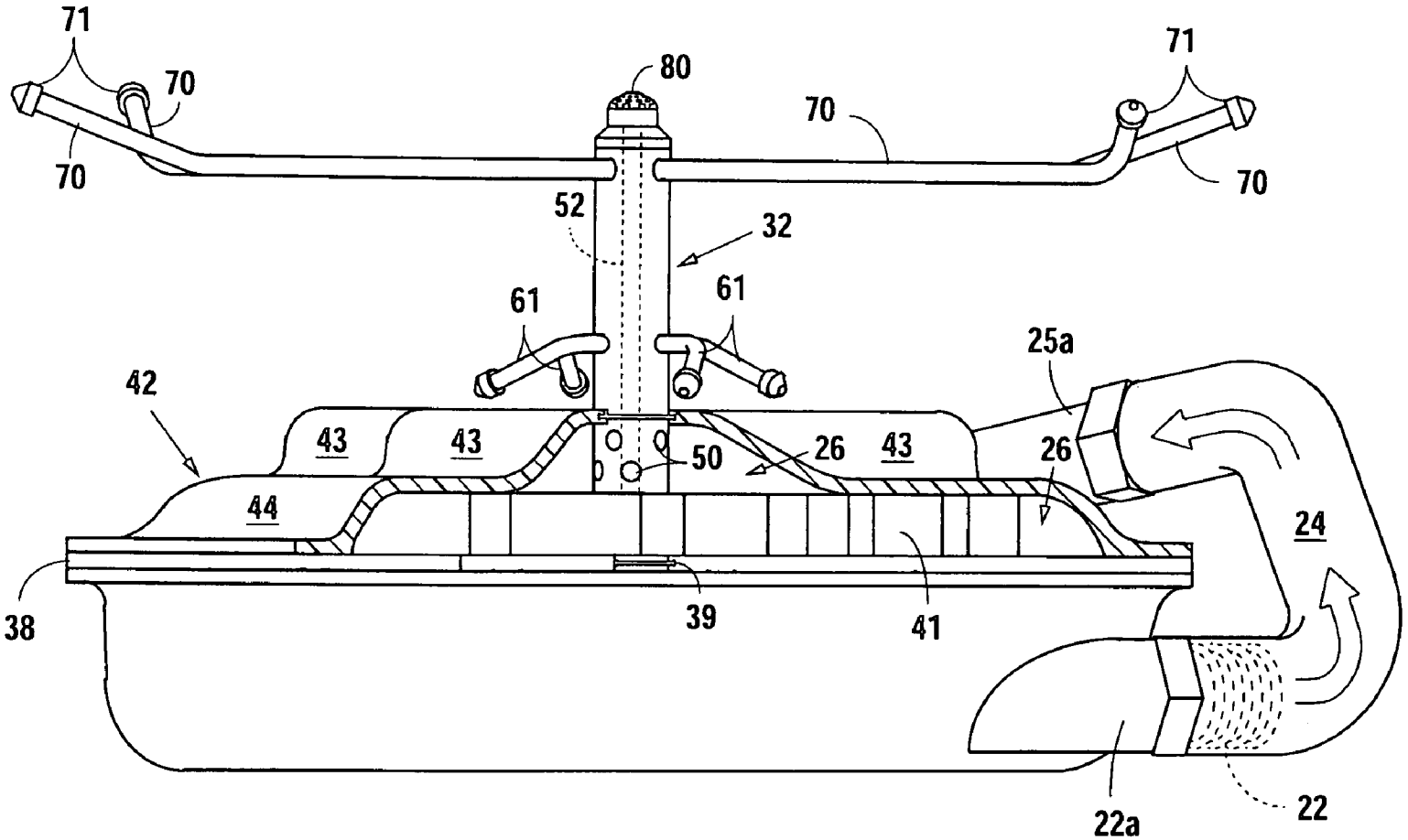
FIG. 5 is an opposite side-elevation view of the present invention shown in FIG. 1, illustrating in a cutaway section, the base cap plate, the lower and upper O-rings, the secondary wheel or turbine, the main shaft with the inlet holes into the shaft from the secondary chamber.
Figure 6:
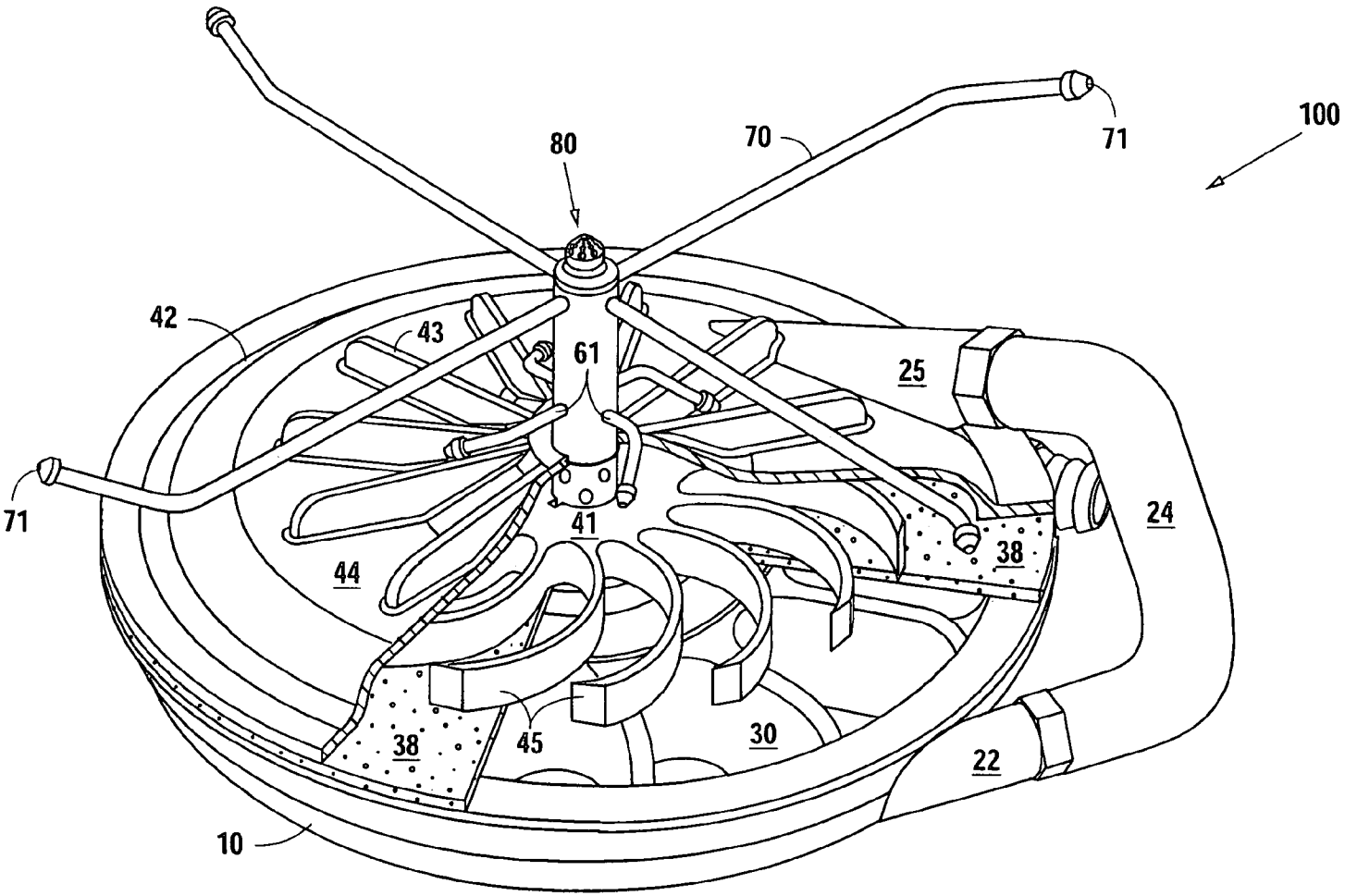
FIG. 6 is a partial cutaway, top perspective view of the present invention showing the primary wheel attached to the main shaft in the base cover and base chamber, the base cap plate dividing the primary and secondary chambers, the secondary wheel attached to the main shaft, the top housing cover with the deflector fins formed in the housing cover, the thruster nozzles, the distribution spray legs and nozzles, and the shower nozzle.
Figure 7:
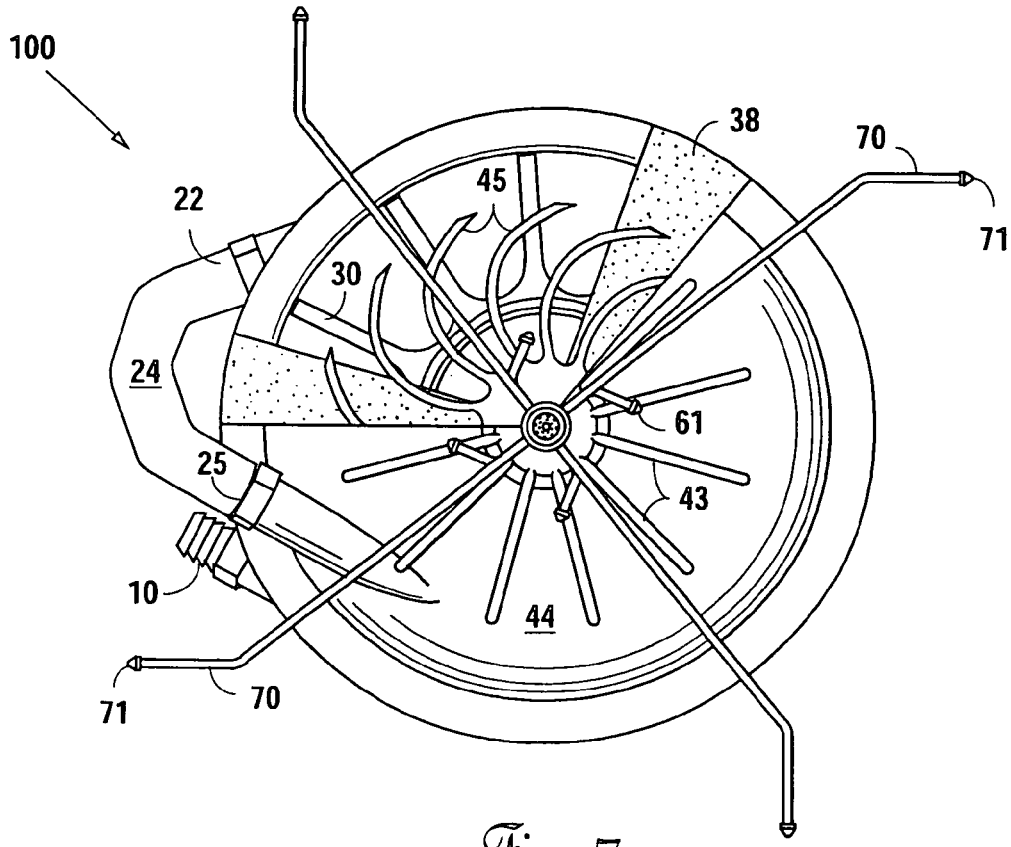
FIG. 7 is a partial cutaway top plan view of the present invention.
Figure 8:
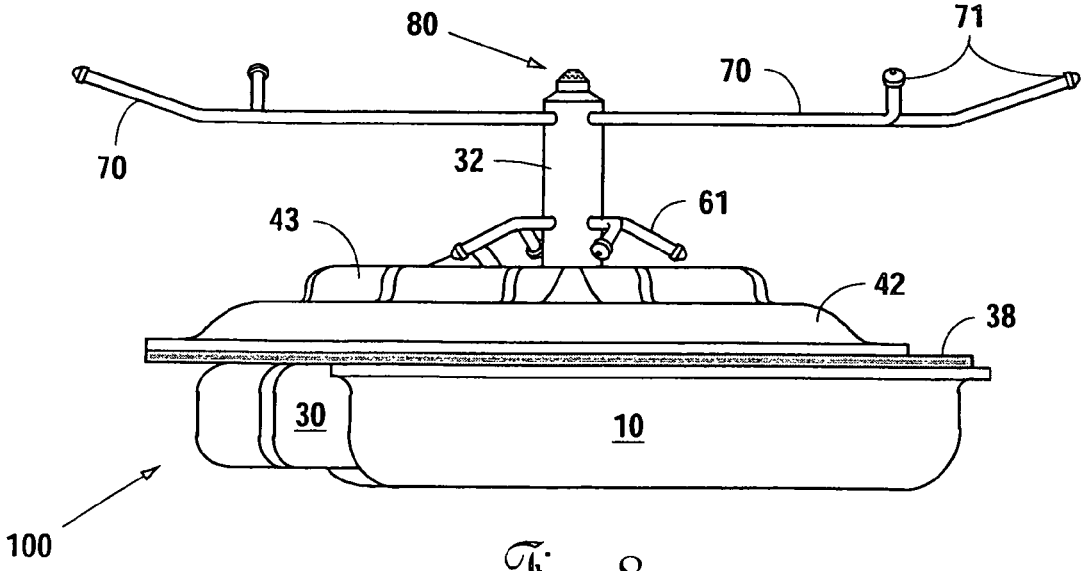
FIG. 8 is a side elevation view showing the primary wheel in a cutaway portion of the base cover.
Figure 9:
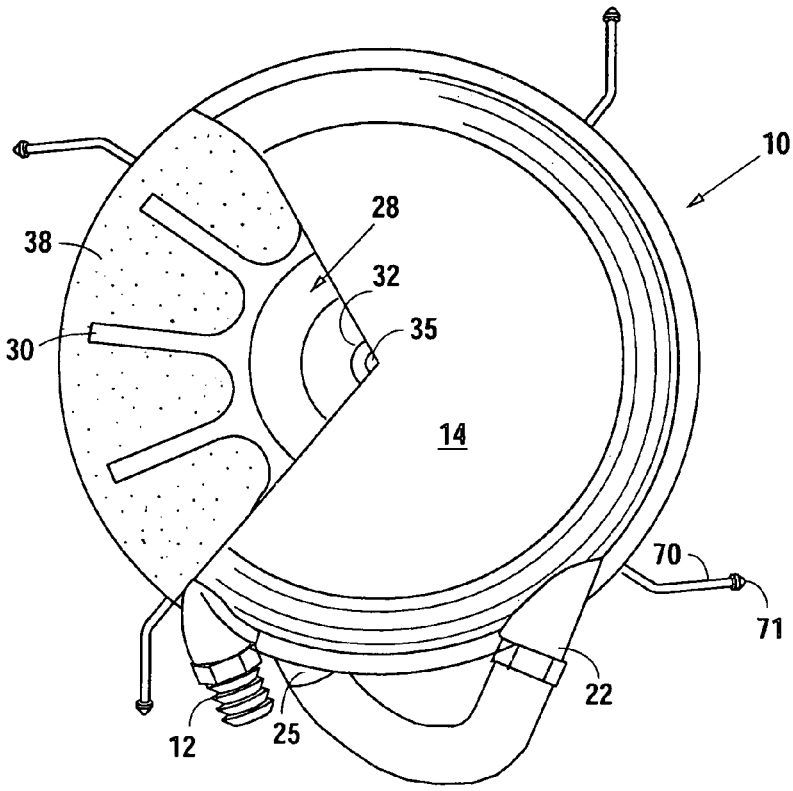
FIG. 9 is a bottom plan view of the present invention with a partial cutaway section showing the primary wheel in the base cover and the base cap plate.

As pressurized water enters secondary chamber 26 as seen in FIGS. 4 and 5, it impacts the secondary or rotor wheel 41 causing it to rotate within the chamber 26 and translate rotational energy to the shaft 32 keyed to the wheel 41. Chamber 26 is formed by the volume between the base cap plate 38 and the upper housing cover 42.

Figure 14:
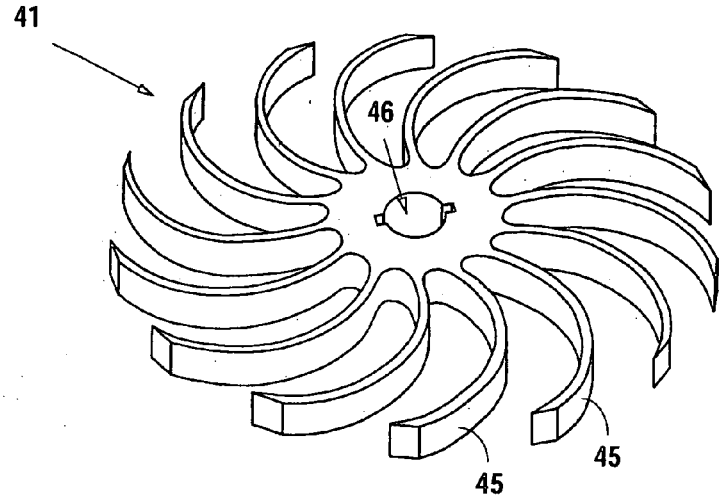
FIG. 14 shows a top perspective view of the secondary wheel or turbine with a central opening (with keyways) for accepting and retaining the main shaft. The wheel blades are arcuate for improving energy transfer from pressurized water entering the secondary chamber.
Figure 15:
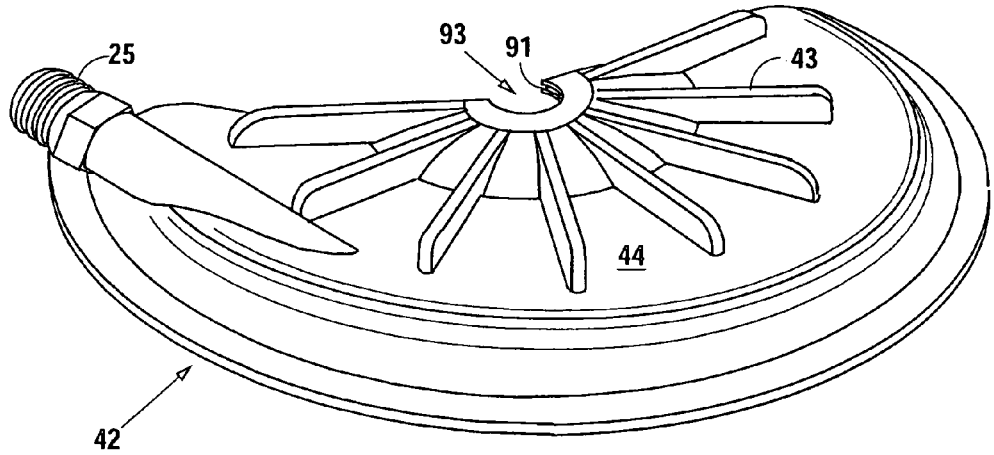
FIG. 15 is a partial cutaway, top perspective view of the top housing cover showing the secondary chamber inlet conduit and a plurality of deflector fins formed in the top surface of the top housing cover.
Figure 16:
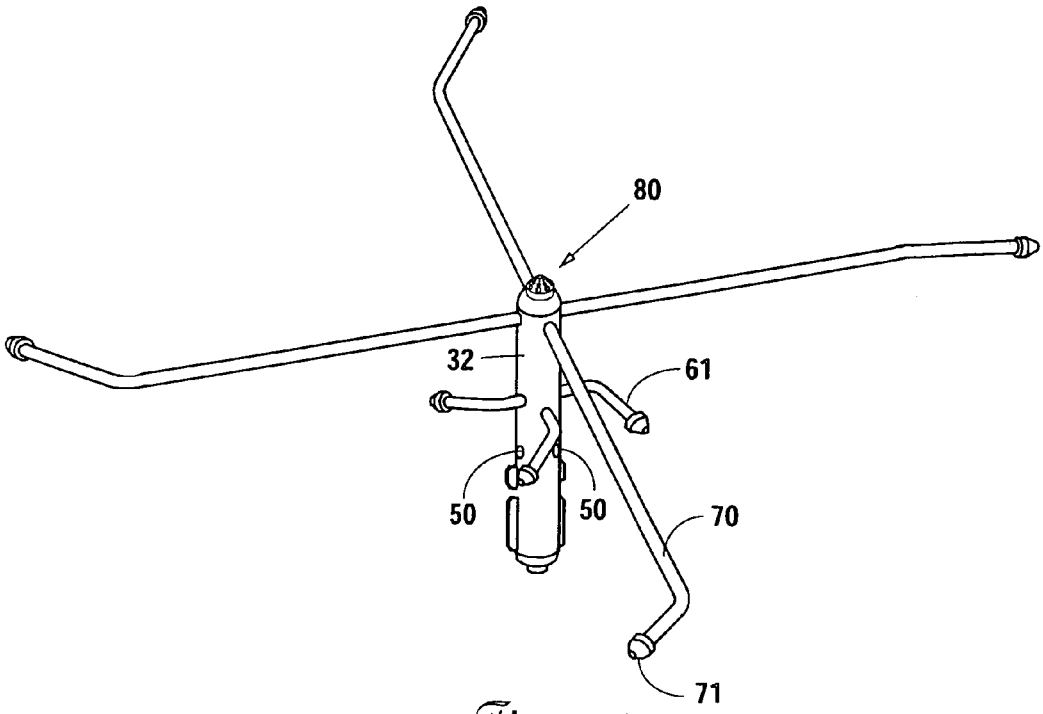
FIG. 16 illustrates the main rotation shaft of FIG. 12 in perspective view showing the central inlet openings and the thruster nozzle assemblies attached to a first set of discharge openings, the distribution legs and nozzles attached to a second set of discharge openings, and the shower nozzle attached to the top of the shaft and in fluid communication with the internal channel in the shaft.
Figure 17:
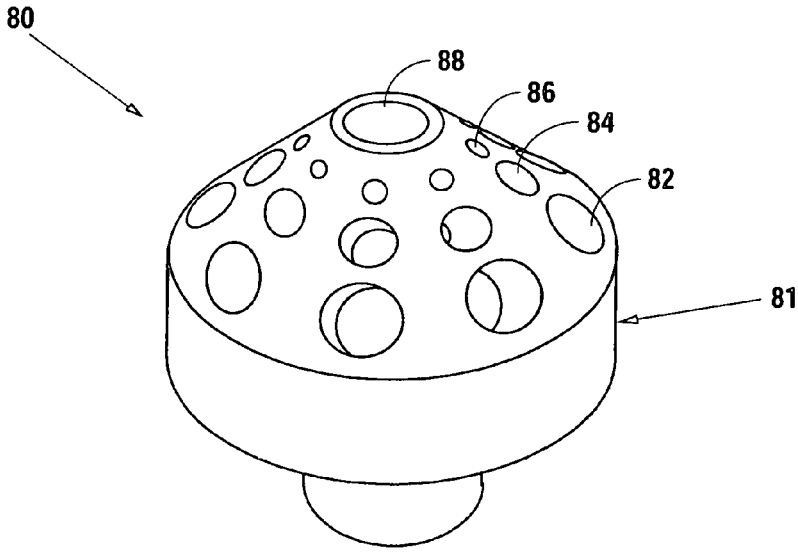
FIG. 17 is a perspective view of the shower nozzle of the present invention.

Wheel 41 has a plurality of arcuate blades 45 which are designed to more effectively transfer energy from the pressurized water to the shaft 32. FIG. 14 illustrates the secondary wheel 41 with blades 45 and a central shaft opening 46 (with keyways) for attaching to the main shaft 32. As may be seen in FIGS. 3 and 12, the key portion 59 of the shaft 32 cooperates with the keyed shaft opening 46.

The pressurized water in the secondary chamber 26 exits the chamber when forced into inlet openings 50 positioned circumferentially about the portion of the shaft 32 disposed in chamber 26. Inlet openings 50 are in fluid communication with an internal channel 52 within the body 56 of the shaft 32 (see FIGS. 5 and 12). The total cross-sectional area of the inlet openings 50 is equal to the cross-sectional area of the inlet opening 12*a* and discharge opening 22*a* in the primary chamber 20 plus the cross-section area of the inlet opening 25*a* of secondary chamber 26.

Figure 12:
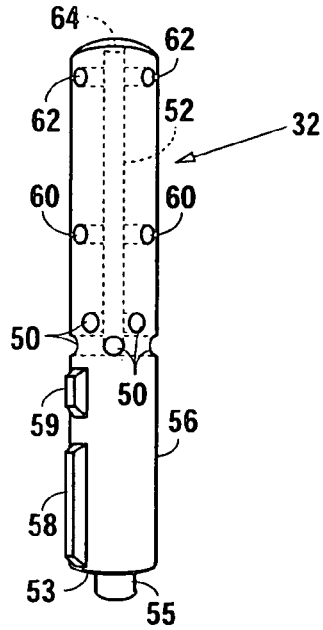
FIG. 12 illustrates a side elevation perspective view of the main shaft with the support journal on the base, keys for cooperation with the key ways on the primary and secondary wheels or turbines, central inlet openings positioned circumferentially about the shaft and communicating with an internal channel to the three sets of upper discharge openings which communicate with the thruster nozzles, the distribution legs, and the shower nozzle, respectively.

FIG. 12 shows a perspective view of the main shaft 32 with support journal 55 which extends from the bottom 53 of the shaft 32 and engages with shoulder 16 in base cover 10. Shaft 32 has a cylindrical body section 56, keys 58 and 59 for cooperation with keyed opening 36 in the primary wheel 28 and keyed opening 46 in secondary wheel 41. Inlet openings 50 are shown in fluid communication with internal channel 52. Thruster outlet openings 60, distribution leg outlet openings 62, and shower nozzle outlet opening 64 also communicate with channel 52 as will be understood from the further description and the drawings.

Turning again to FIG. 5, it may be seen that thruster nozzles 61 are fitted into thruster outlet openings 60 in the shaft 32 and are capable of discharging pressurized water which has entered internal channel 52. Water discharged from thruster nozzles 61 is directed by the downward bend of the nozzle tubing to impact against the stationary deflector fins 43 formed into the outer surface 44 of the upper housing cover 42. The water hitting the fins 43 is then deflected outwardly to the environment being sprinkled. A reaction force of the discharged water against the fins 43 cause a thruster nozzle 61 to impart rotational force to the shaft 32.

Additionally, a portion of the pressurized water in channel 52 travels further upwardly and is directed to distribution legs 70 and out distribution nozzles 71. Water discharged from distribution nozzles 71 is intended to be sprayed at a greater distance from the sprinkler housing (base 10 and cover 42) than the water deflecting off the fins 43. As with thruster nozzles 61, distribution nozzles 71 have a reaction force which imparts rotational energy to the shaft 32.

A further water discharge to the environment is provided by shower nozzle 80, having a plurality of various sized openings 82, 84, 86, and 88, in fluid communication with internal channel 52. Shower nozzle 80 creates a different spray pattern depending upon the placement and size of openings 82, 84, 86, and 88, around the nozzle head 81. Discharge rate of water from the sprinkler 100 may be controlled by rotating nozzle 80 to expose appropriate opening to the internal channel 52 and by further varying the discharge orifice size on nozzles 61 and 71.

Figure 18:
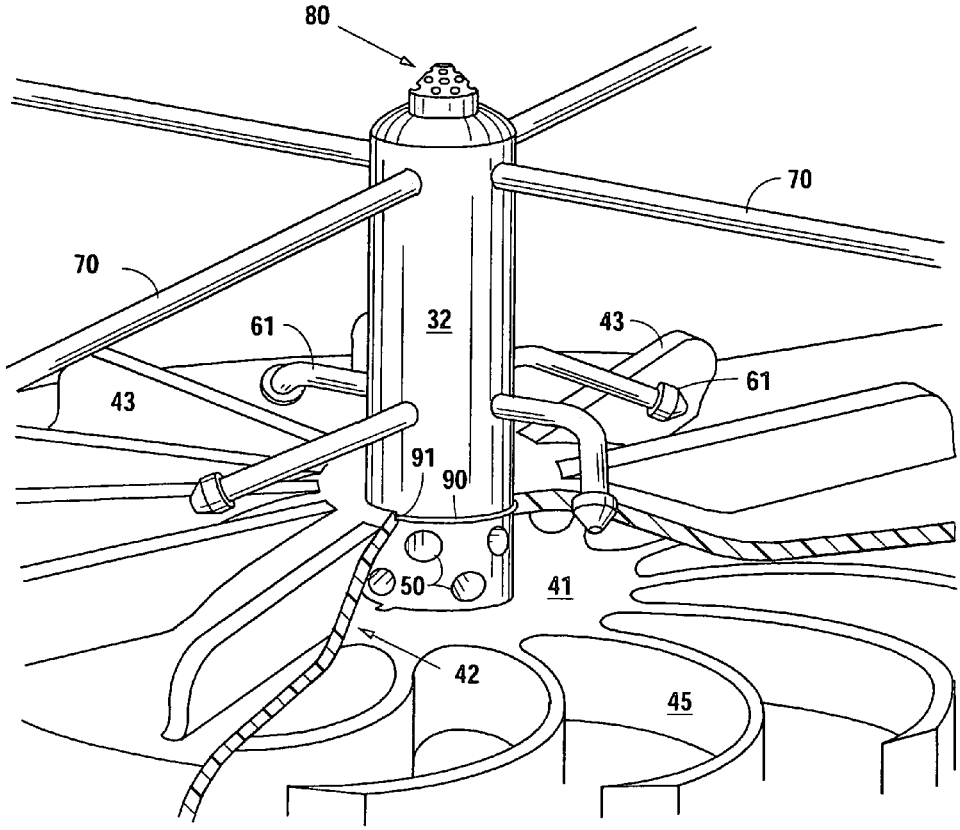
FIG. 18 is a detailed, perspective view of the main shaft attached to the secondary wheel, the central inlet opening to the shaft from the secondary chamber, and the sealing O-ring in the appropriate ring grooves in the top housing cover.

FIG. 18 illustrates a detailed partially exposed perspective view of the shaft 32 and upper sealing O-ring 90. O-ring 90 fits into a sealing groove 91 around shaft opening 93 in the upper housing cover 42. The ring 90 elastically urges against the outer surface of shaft 32 to seal water within the secondary chamber 26.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A water sprinkler comprising:

an inlet water conduit with an opening in fluid communication with a pressurized water supply source and a primary chamber within a non-rotatable sprinkler housing;

a primary turning wheel attached to a main shaft support journal rotatably disposed within said primary chamber, said primary turning wheel adapted to rotate by the force of water from said pressurized water supply source impacting on said primary turning wheel;

a fluid discharge conduit with an opening in fluid communication with said primary chamber and an inlet opening in a secondary chamber within said sprinkler housing, said secondary chamber separated from said primary chamber by a top cap plate, and having a volume defined between said top cap plate and an upper housing cover; and a secondary turning wheel attached to said main shaft support journal rotatably disposed within said secondary chamber, said secondary turning wheel is rotatable by the force of water discharged from said primary chamber through said fluid discharge conduit and impacting blades on said secondary turning wheel.

2. The sprinkler of claim 1 wherein said primary turning wheel comprises a plurality of radially extending blades for receiving said force of said ater and imparting rotational force to said main shaft support journal.

3. The sprinkler of claim 2 wherein said secondary turning wheel comprises a plurality of radially extending arcuate blades for receiving said force of said water discharged from said primary chamber and imparting rotational force to said main shaft support journal.

4. The sprinkler of claim 1 further comprising a cap plate sealingly separating said primary chamber within said sprinkler housing from said secondary chamber within said sprinkler housing.

5. The sprinkler of claim 1 further comprising:

a plurality of inlet openings positioned circumferentially about a section of said main shaft support journal disposed within said secondary chamber, said plurality of circumferentially positioned inlet openings in fluid communication with said secondary chamber and a central internal channel within said main shaft support journal; and a plurality of outlet openings in a portion to said main shaft support journal outside said secondary chamber, said plurality of outlet openings in fluid communication with said central internal channel within said main shaft support journal.

6. The sprinkler of claim 5 further comprising:

thruster nozzles attached to and in fluid communication with a first portion of said plurality of outlet openings, said thruster nozzles adapted to direct a first portion of discharge water against deflector fins on an outer surface of said sprinkler housing and to impart rotational force to said main shaft support journal;

distribution nozzles attached to and in fluid communication with a second portion of said plurality of outlet openings, said distribution nozzles adapted to direct a second portion of discharge water outwardly from said main shaft support journal; and shower nozzles attached to and in fluid communication with a third portion of said plurality of outlet openings, said shower nozzles adapted to direct a third portion of discharge water outwardly from said main shaft support journal.

7. The sprinkler of claim 5 wherein the cross-sectional area of the plurality of outlet openings is equal to the cross-sectional area of said inlet and discharge openings in said primary and second chambers.

* * * * *